US005501573A

United States Patent [19]

Sanders

[11] Patent Number: 5,501,573

[45] Date of Patent: Mar. 26, 1996

[54] SEGMENTED SEAL ASSEMBLY AND METHOD FOR RETROFITTING THE SAME TO TURBINES AND THE LIKE

[75] Inventor: William P. Sanders, Aurora, Canada

[73] Assignee: Steam Specialties, Inc., Burnt Hills, N.Y.

[21] Appl. No.: 326,068

[22] Filed: Oct. 19, 1994

Related U.S. Application Data

[63] Continuation of Ser. No. 11,190, Jan. 29, 1993.

[51] Int. Cl.[6] ..... F01D 5/20; F01D 11/08

[52] U.S. Cl. ..... 415/173.5; 415/173.6; 416/189; 29/888.021; 29/889.21; 29/889.22; 29/889.7; 277/53

[58] Field of Search ..... 415/173.1, 173.4, 415/173.5, 173.6, 174.4, 174.5; 416/189, 190, 191, 192, 195, 196 R; 29/888.021, 888.3, 889.22, 889.21, 889.7; 277/53, 55, 56, 57

[56] References Cited

U.S. PATENT DOCUMENTS

| | | | |
|---|---|---|---|
| 2,970,808 | 2/1961 | Coppa | 416/190 |
| 3,000,552 | 9/1961 | Cooper, Jr. et al. | 415/174.4 |
| 3,501,246 | 3/1970 | Hickey | 415/173.6 |
| 3,572,968 | 3/1971 | Musick | 416/190 |
| 3,702,221 | 11/1972 | Ortolano | 416/191 |
| 3,867,060 | 2/1975 | Huber | 415/173.5 |
| 4,816,213 | 3/1989 | Groenendaal, Jr. | 415/134 |
| 5,056,989 | 10/1991 | Turner et al. | 415/914 |

FOREIGN PATENT DOCUMENTS

| | | | |
|---|---|---|---|
| 1111037 | 2/1965 | France | 415/173.6 |
| 0187801 | 7/1992 | Japan | 415/173.1 |
| 0141041 | 2/1961 | U.S.S.R. | 416/195 |
| 0851323 | 10/1960 | United Kingdom | 415/173.4 |

*Primary Examiner*—Edward K. Look
*Assistant Examiner*—Christopher Verdier
*Attorney, Agent, or Firm*—Hopgood, Calimafde, Kalil & Judlowe

[57] ABSTRACT

A segmented seal assembly for retrofitting existing turbine units and the like. In accordance with one aspect of the present invention, the assembly comprises a plurality of semicircular segments disposed between a turbine casing and moving blades of a turbine shaft. Each segment is mounted by threaded fasteners to at least one inner surface of the unit and configured for cooperation with the same. On inner surfaces of the segments are at least two rows of seal teeth, disposed facially with the moving blades. Upon assembly of the segments into a seal ring, fluid flow over the moving blades is limited. Cover band elements layered upon outer surfaces of the moving blades prevent damage to the seal teeth and limit fluid flow over the blades.

9 Claims, 2 Drawing Sheets

SEGMENTED SEAL ASSEMBLY AND METHOD FOR RETROFITTING THE SAME TO TURBINES AND THE LIKE

This application is a continuation of application Ser. No. 08/011,190, filed Jan. 29, 1993.

BACKGROUND OF THE INVENTION

The present invention relates to seals for use in fluid dynamic systems, and more particularly to a segmented seal assembly and method of retrofitting the same to turbines and the like.

Efficient operation of pressurized fluid systems, e.g., turbines, compressors and pumps, requires that high and low pressure operations be separate from one another. This is particularly true at the junctures of stationary and moving parts.

Many sealing systems have been developed for this purpose. Labyrinth seals, for example, use a segmented seal ring between moving blades of a rotating turbine shaft and a stationary turbine casing. The seal rings typically have a plurality of seal teeth for reducing the radial gap between the moving blades and casing to several thousandths of an inch. Some seal teeth extend radially inward and are spaced axially at intervals along the seal ring in opposition to the outer diameter of the shaft circumference. The objective is to effect a seal between the moving blades and the casing by restricting fluid flow between high and low pressure regions along the rotating shaft.

Upon failure of the seal, however, extensive machining may be required to replace it. In some cases, seal attachments are so weakened that replacement and maintenance of the seal are not feasible. The turbine unit must then operate without a complete set of seals, with reduced efficiency and at great expense to the operator. Given the unstable nature of worn or damaged seals, unit operation must be at reduced power levels in an effort to maintain reliable operation.

SUMMARY OF THE INVENTION

In accordance with one aspect of the present invention, there is provided a segmented seal assembly for retrofitting existing turbine units and the like, the assembly comprising a plurality of semicircular segments disposed between a turbine casing and moving blades of a turbine shaft. Each segment is mounted by threaded fasteners to at least one inner surface of the turbine unit and configured for cooperation with the same. On inner surfaces of the segments are seal teeth, disposed facially with the moving blades. Upon assembly of the segments into a seal ring, fluid flow over the moving blades is limited. Cover band elements layered upon outer surfaces of the moving blades prevent damage to the seal teeth and limit fluid flow over the blades.

The present invention is directed to a segmented seal assembly for retrofitting existing turbine units and the like, the assembly comprising:

a plurality of semicircular segments disposed between a turbine casing and moving blades of a turbine shaft, each segment being configured for cooperation with at least one inner surface of the unit;

at least one threaded fastener for mounting each segment to the inner surface, whereupon assembly of the segments into a seal ring, fluid flow over the moving blades is limited.

The present invention is further directed to a method for retrofitting existing turbine units and the like with a segmented seal assembly, which comprises the steps of:

disposing a plurality of semicircular segments between a turbine casing and moving blades of a turbine shaft, each segment being configured for cooperation with at least one inner surface of the unit;

mounting each segment to the inner surface using at least one threaded fastener, whereupon assembly of the segments into a seal ring, fluid flow over the moving blades is limited.

Accordingly, it is an object of the present invention to retrofit turbines and the like with a new seal assembly where either an existing seal system has failed or there is no seal system above the moving blades.

It is another object of the present invention to provide a more efficient and economical fluid dynamic system.

It is still another object of the present invention to retrofit segments of a segmented seal assembly to a turbine unit without machining or use of existing attachments.

The present invention will now be further described by reference to the following drawings which are not to be deemed limiting in any manner.

BRIEF DESCRIPTION OF THE DRAWINGS

The same numerals are used throughout the various figures of the drawings to designate similar parts.

Still other objects and advantages of the present invention will become apparent from the following description of the preferred embodiments.

DETAILED DESCRIPTION OF THE PREFERRED EMBODIMENTS

A conventional turbine includes a rotor or shaft centrally located and housed within a stationary casing 20 which comprises two semicylindrical halves. Radially disposed blades 40 (known as a blade row) are arranged about the turbine shaft circumference for channeling a system fluid, e.g., steam, through the turbine. To effect movement of the blades, high pressure steam cascades through a series of stages at intervals along the shaft length. Each stage operates at a different pressure, the pressure differentials being maintained by interstage casing seals which separate the various stages. A series of seal rings are typically used for this purpose. The objective of the seal rings is generally to limit the quantity of fluid which bypasses the turbine blades from the path of fluid flow through the turbine.

The foregoing discussion is provided for purposes of illustration and is not to be deemed limiting as to the intended environment for use of the present invention. The remaining structural and functional aspects of turbines are known by those skilled in the art and further description is believed unnecessary for illustration of the present invention.

Figure 1:
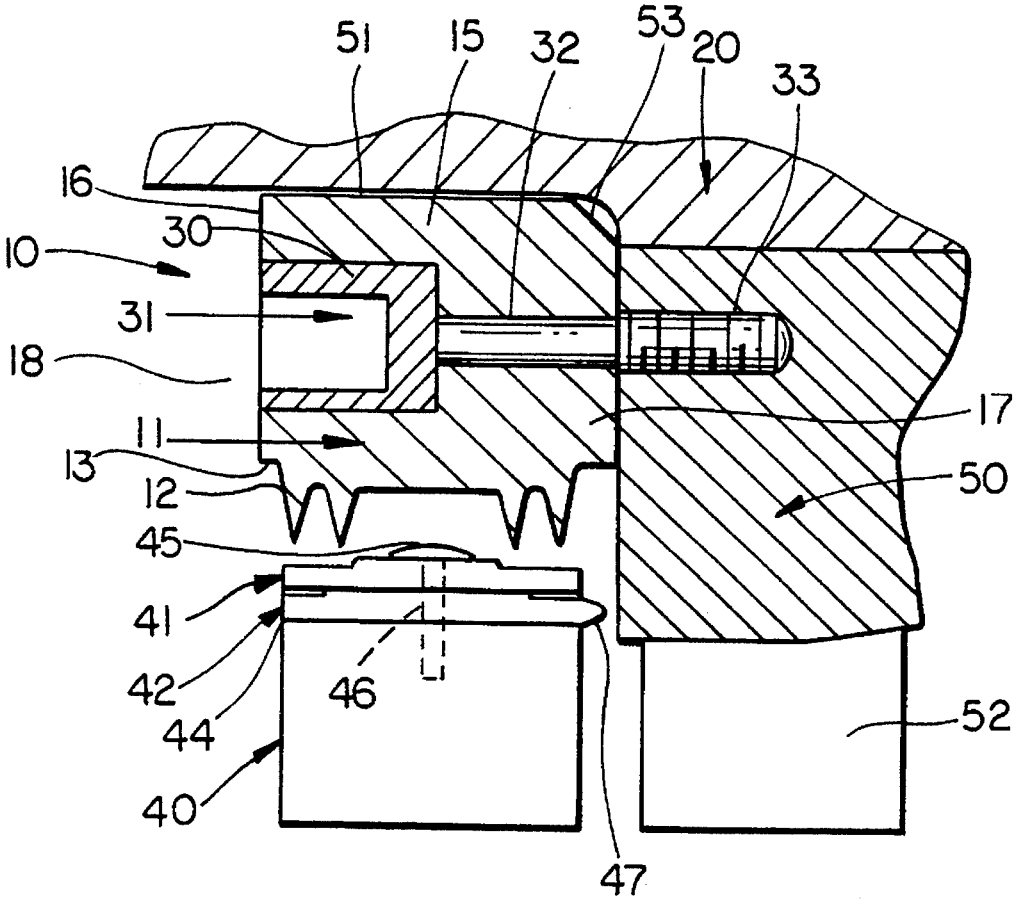
FIG. 1 is a sectional view of a segmented seal assembly in accordance with one aspect of the present invention.
Figure 2:
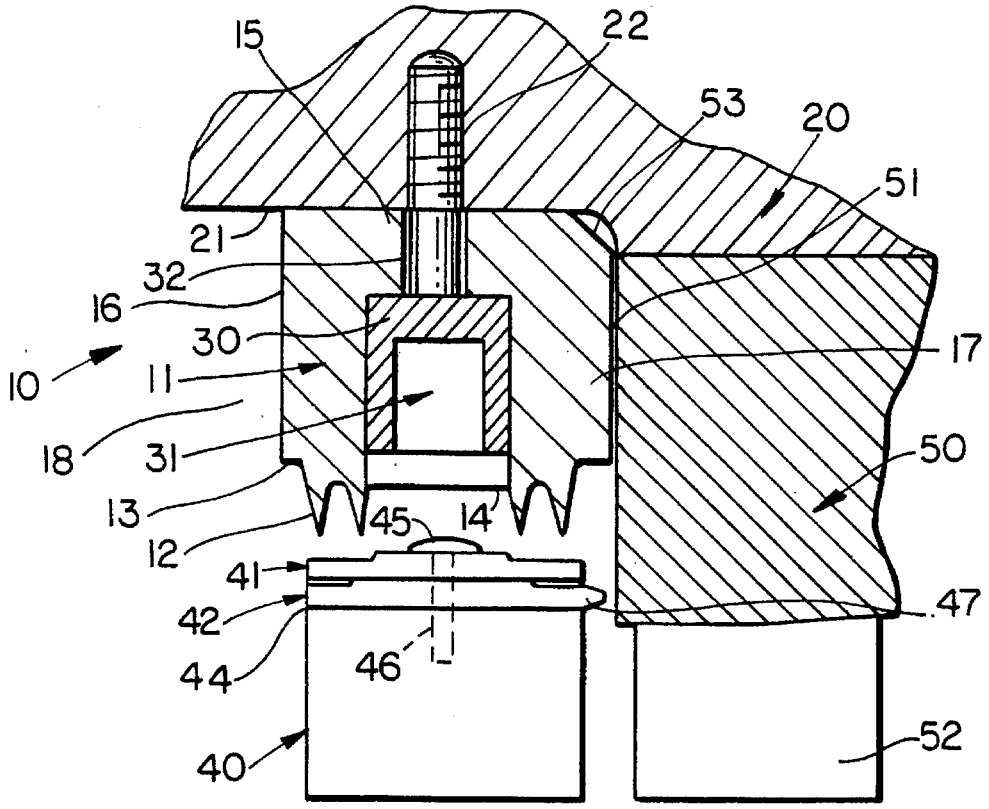
FIG. 2 is a sectional view of a segmented seal assembly in accordance with another aspect of the present invention.
Figure 3:
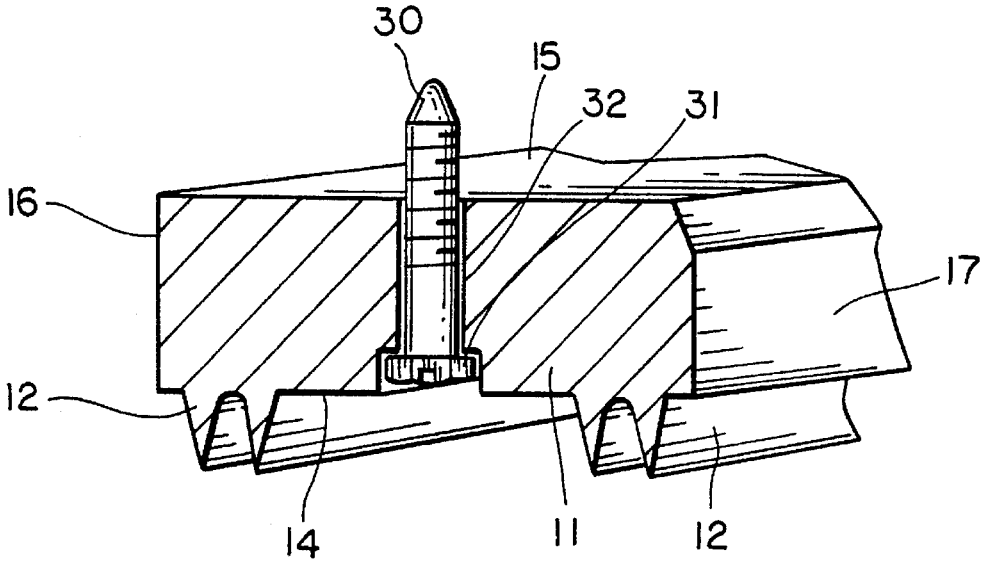
FIG. 3 is a perspective sectional view of a seal assembly segment in accordance with still another aspect of the present invention.

Returning now to the drawings, FIGS. 1–3 generally illustrate a segmented seal assembly 10 for use in a steam turbine, in accordance with various aspects of the present invention. The assembly includes a plurality of arcuate seal ring segments 11 mounted to the casing interior 21, each by at least one threaded fastener 30. Seal teeth 12 are arranged on face 13 of the segment, opposite the moving blades. Cover band portions 41, 42 are layered on the blades to prevent damage should they contact the teeth and to limit flow over the blades. Installation of the assembly maintains pressure differentials along the moving blades of the rotating shaft which passes through the stationary turbine casing.

The segments are nestled between the stationary casing and the moving blades, adjacent nozzle block 50. Typically, a series of these arcuate seal ring segments, e.g, 4 or more per ring, are necessary to surround the shaft and form a seal ring (not shown). Each segment has a generally block-like shape with radial inner 14 and outer 15 surfaces and axial side surfaces 16, 17. The inner surface mounts seal teeth 12, e.g., two rows, which are preferably arranged symmetrically about the segment's inner surface area. It is also preferred that the outer surface abut the inner surface of the outer casing.

To secure the segment to the casing interior, each segment is provided with one or more bores 32, each for receiving a threaded fastener 30, e.g., a set screw. As shown in FIG. 2, the bore extends radially through segment 11, from outer surface 15 to inner surface 14. This is known as the radial seal attachment method. The bore diameter abruptly changes generally midway along the length of the bore to accommodate fastener head 31. It is preferred that the bore be located generally at the geometric center of the segment to minimize torque and thereby insure its securement to the casing. It is also preferred that each segment have three bores and fasteners to insure securement.

Each fastener and segment bore are fit to a small clearance so as to allow accurate positioning of the segment within the casing. Suitable fasteners include bolts, rivets, set screws and set studs.

Upon receipt of the fastener by the segment, the fastener is threadably engaged with a mounting bore 22 in a selected surface of the turbine unit, e.g., stationary casing 20. The segment is thereby secured to the turbine unit. In this fashion, the present invention advantageously provides for ready installation, removal, replacement and adjustment of either individual seal segments or a complete seal assembly.

Pairs of teeth 12 extend from and perpendicular to the inward surface of the segment, segment face 13. Each tooth, i.e., of one or more pairs, is relatively equal in length to the others, e.g., 0.375 inch. Upon installing the segment to the turbine unit, the teeth are interposed with and in opposition to a relatively flat upper surface 44 of moving blades 40. A relatively close tolerance or radial clearance between the teeth and blades is maintained, preferably within the range of 0.016– 0.020 inch. This insures minimal fluid flow, e.g., of steam, across the blades.

Cover band portions 41, 42, one inner and one outer, are layered upon moving blade surface 44 to limit fluid flow over the blades and to protect the blades and seal teeth from damage due to rubbing between them. Blade-seal teeth contact may result, for example, from thermal distortion, bowed rotors and vibration during the initial start-up period (acceleration) and system shut-down (deceleration).

The band portions or layers are secured to the blades, preferably by passing a fastener 45, e.g., a rivet, through a hole 46 in each band and into the outer blade surface. For added securement, holes 46 in each band are chamfered so that their edges extend into the layer or surface below. Suitable materials for the cover band portions include a chromoly 400 series metal, e.g., stainless steel 422.

Alternatively or concurrently therewith, inner cover band portion 42 has a tooth 47 for confining fluid to a selected flow path along the moving blades. The tooth extends a selected distance axially toward nozzle block 50. It is preferred that the resulting tooth to cover band clearance be sufficient to contain the fluid flow, e.g., steam, along the nozzle block and blades within the steam path. Because the tooth may become worn causing leakage of fluid, the present invention may serve as a back-up seal system.

In another alternative embodiment of the present invention, the cover band comprises a single layer, or more than two layers. In still another embodiment, the cover band is formed integrally with the blade surface.

A seal receiving cavity 18 for operatively locating seal ring segment 11 is formed at the juncture of casing 20 and nozzle block 50. Upon locating the segment at the juncture, the outer surface of the segment abutting the casing, the segment is secured in place. A relatively small clearance 51 is maintained between the segment side adjacent the nozzle block and the nozzle block, the nozzle block being mounted atop a fixed blade row 52 and formed integrally therewith.

Corner 53 of the segment which abuts the turbine is chamfered or sloped, e.g., 0.25 inch by 0.25 inch, to form a stress relieving radius (space) therebetween. This prevents the segment from interfering with the casing fillet radius, thereby allowing the segments to be retrofitted to a variety of turbine designs.

In another alternative embodiment of the present invention, as shown in FIG. 1, bore 32 extends axially, from side 16 to side 17, across the segment. In this manner, the fastener is received horizontally by the segment for securing the segment to the nozzle block rather than the casing. A second, generally horizontal bore 33 in the nozzle block then threadably receives the fastener to secure the segment thereto. This is known as the axial seal attachment method.

Although the present invention is shown and described as suitable for mounting the segment either axially or radially, it is understood by those skilled in the art that the orientation of mounting depends upon the fixed blade design and other characteristics of the environment to which the present invention is intended. It is also understood that fasteners and bores may be otherwise oriented relative to the nozzle block or casing within the spirit and scope of the present invention.

Segment side 17 adjacent to the nozzle block abuts the nozzle block. A relatively small clearance is also maintained between the segment upper surface and the casing. This clearance allows for expansion of the turbine unit over a full range of operating conditions.

While the present invention has been shown and described with reference to a particular seal and turbine geometry or arrangement, it is understood that any geometry and/or arrangement could be used giving consideration to the purpose and environment for which the present invention is intended. For example, it is preferred that the fasteners and other assembly components be selected according to the desired manufacturing specifications and design criteria, their cross-section and material being able to withstand the energies generated during operation of the turbine in accordance with the objectives of the present invention. In a further alternative embodiment, unthreaded fasteners, e.g., releasable friction pins, could also be used in accordance with the present invention.

To assemble the segmented seal assembly, a plurality of semicircular segments are disposed between the turbine casing and moving blades. Each segment is configured for cooperation with an inner surface of the unit, e.g., either the casing or nozzle block.

The segments are then mounted to the inner surface, e.g., by screwing a threaded fastener such as a set screw to the inner surface and tightening the same. Upon placing the segment in the cavity and securing the same to the inner surface, a segmented seal assembly has been retrofitting to the steam turbine. One or more cover band portions are mounted to the moving blade upper surface. In this manner, fluid flow over the moving blades is limited.

The segmented seal assembly of the present invention is preferably produced from a seal ring assembly by separating the same into segments. This allows replacement of individual segments upon damage to only a portion of the original seal ring.

The segments are preferably designed such that upon their assembly into a complete segmented seal ring, the ring is constrained by the fasteners and prevented from roaming about and damaging turbine parts, e.g., the moving blades, during turbine operations such as start-up or shut-down.

Whether operating at minimum or maximum pressure conditions, this novel seal assembly is easily retrofitted to an existing turbine unit, while advantageously maintaining a seal between the blades and casing. Turbine efficiency and operating power levels are thereby maintained.

Although the embodiments illustrated herein have been described for use with a steam turbine, their adaptation to any device and fluid dynamic system, e.g., compressors or pumps, where seals may be needed is understood giving consideration to the purpose for which the present invention is intended.

Since from the foregoing the construction and advantages of the present invention may be readily understood, further explanation is believed unnecessary. However, since numerous modifications will readily occur to those skilled in the art after consideration of the foregoing specification and accompanying drawings, it is not intended that the invention be limited to the exact construction shown and described, but rather all suitable modifications and equivalents may be resorted to which fall within the scope of the appended claims.

What is claimed is:

1. A segmented seal assembly for retrofitting existing turbine units, the assembly comprising:

a plurality of semicircular arcuate seal ring segments disposed between a turbine casing and moving blades of a turbine shaft, each segment being configured for cooperation with an inner surface of the unit, the inner surface being a portion of the casing;

at least one threaded fastener for mounting each segment to the inner surface, whereupon assembly of the segments into a seal ring, fluid flow over the moving blades is limited;

a first cover band mounted to an outer surface of the moving blades so as to limit fluid flow over the blades and protect the blades and seal from damage due to contact between them; and a second cover band mounted to the first cover band, the first and second cover bands being secured to the blades, the first cover band having a projection oriented so as to confine the fluid flow to a selected flow path along the moving blades, each cover band being one piece and circumferentially continuous.

2. The segmented seal assembly set forth in claim 1 wherein the turbine unit is part of a steam turbine.

3. A method for retrofitting existing turbine units with a segmented seal assembly, which comprises the steps of:

a. disposing a plurality of arcuate seal ring segments between a turbine casing and moving blades of a turbine shaft, each segment being configured for cooperation with an inner surface of the unit, the inner surface being a portion of the casing;

b. mounting each segment to the inner surface using at least one threaded fastener, whereupon assembly of the segments into a seal ring, fluid flow over the moving blades is limited;

c. mounting a first cover band to an outer surface of the moving blades so as to limit fluid flow over the blades and protect the blades and seal from damage due to contact between them; and d. mounting a second cover band to the first cover band so as to further limit fluid flow over the blades and protect the blades and seal from damage due to contact between them, the first cover band having a projection oriented so as to confine the fluid flow to a selected flow path along the moving blades, each cover band being one piece and circumferentially continuous.

4. A segmented seal assembly for retrofitting existing turbine units, the assembly comprising:

a segment disposed between a turbine casing and moving blades of a turbine shaft, the segment being configured for cooperation with an inner surface of the unit, the inner surface being a portion of the casing;

at least one threaded fastener for mounting the segment to the inner surface so as to limit fluid flow over the moving blades;

a first cover band mounted to an outer surface of the moving blades so as to limit fluid flow over the blades and protect the blades and seal from damage due to contact between them; and a second cover band mounted to the first cover band, the first and second cover bands being secured to the blades, the first cover band having a projection oriented so as to confine the fluid flow to a selected flow path along the moving blades, each cover band being one piece and circumferentially continuous.

5. A method for retrofitting existing turbine units with a segmented arcuate seal ring assembly, which comprises the steps of:

a. disposing a segment of the assembly between a turbine casing and moving blades of a turbine shaft, each segment being configured for cooperation with an inner surface of the unit, the inner surface being a portion of the nozzle block of the turbine unit;

b. mounting the segment to the inner surface using at least one threaded fastener so as to limit fluid flow over the moving blades;

c. mounting a first cover band to an outer surface of the moving blades so as to limit fluid flow over the blades and protect the blades and seal from damage due to contact between them; and d. mounting a second cover band to the first cover band so as to further limit fluid flow over the blades and protect the blades and seal from damage due to contact between them, the first cover band having a projection oriented so as to confine the fluid flow to a selected flow path along the moving blades, each cover band being one piece and circumferentially continuous.

6. A segmented arcuate seal ring assembly for retrofitting existing turbine units, the assembly comprising: a segment disposed between a turbine casing and moving blades of a turbine shaft, the segment being configured for cooperation with an inner surface of the unit, the inner surface being a portion of a nozzle block of the turbine unit; at least one fastener for detachably securing the segment to the inner surface so as to limit fluid flow over the moving blades; a first cover band mounted to an outer surface of the moving blades so as to protect the blades and seal; and a second cover band mounted to the first cover band, the first and second cover bands being secured to the blades, the first cover band having a projection oriented so as to confine the fluid flow to a selected flow path along the moving blades, each cover band being one piece and circumferentially continuous.

7. A segmented seal assembly for retrofitting existing turbine units, the assembly comprising:

a plurality of arcuate seal ring segments disposed between a turbine casing and moving blades of a turbine shaft, each segment being configured for cooperation with an inner surface of the unit, the inner surface being a portion of a nozzle block of the turbine unit;

at least one threaded fastener for mounting each segment to the inner surface, whereupon assembly of the segments into a seal ring, fluid flow over the moving blades is limited;

a first cover band mounted to an outer surface of the moving blades so as to limit fluid flow over the blades and protect the blades and seal from damage due to contact between them; and a second cover band mounted to the first cover band, the first and second cover bands being secured to the blades, the first cover band having a projection oriented so as to confine the fluid flow to a selected flow path along the moving blades, each cover band being one piece and circumferentially continuous.

8. A method for retrofitting existing turbine units with a segmented seal assembly, which comprises the steps of:

a. disposing a plurality of arcuate seal ring segments between a turbine casing and moving blades of a turbine shaft, each segment being configured for cooperation with an inner surface of the unit, the inner surface being a portion of a nozzle block of the turbine unit;

b. mounting each segment to the inner surface using at least one threaded fastener, whereupon assembly of the segments into a seal ring, fluid flow over the moving blades is limited;

c. mounting a first cover band to an outer surface of the moving blades so as to limit fluid flow over the blades and protect the blades and seal from damage due to contact between them; and d. mounting a second cover band to the first cover band so as to further limit fluid flow over the blades and protect the blades and seal from damage due to contact between them, the first cover band having a protection oriented so as to confine the fluid flow to a selected flow path along the moving blades, each cover band being one piece and circumferentially continuous.

9. A method for retrofitting existing turbine units with a segmented arcuate seal ring assembly, which comprises the steps of:

a. disposing a segment of the assembly between a turbine casing and moving blades of a turbine shaft, each segment being configured for cooperation with an inner surface of the unit, the inner surface being a portion of the casing;

b. mounting the segment to the inner surface using at least one threaded fastener so as to limit fluid flow over the moving blades;

c. mounting a first cover band to an outer surface of the moving blades so as to limit fluid flow over the blades and protect the blades and seal from damage due to contact between them; and d. mounting a second cover band to the first cover band so as to further limit fluid flow over the blades and protect the blades and seal from damage due to contact between them, the first cover band having a projection oriented so as to confine the fluid flow to a selected flow path along the moving blades, each cover band being one piece and circumferentially continuous.

* * * * *